US011982276B2

(12) United States Patent
Rosenbach et al.

(10) Patent No.: US 11,982,276 B2
(45) Date of Patent: May 14, 2024

(54) SCROLL COMPRESSOR FOR REFRIGERANT-OIL MIXTURES WITH OIL RETURN

(71) Applicant: Hanon Systems, Daejeon (KR)

(72) Inventors: Philipp Rosenbach, Aachen (DE); Michael Friedl, Pulheim (DE); Dirk Gutberlet, Würselen (DE); Kadir Dursun, Hürth (DE)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/003,620

(22) PCT Filed: Nov. 11, 2021

(86) PCT No.: PCT/KR2021/016395
§ 371 (c)(1),
(2) Date: Dec. 28, 2022

(87) PCT Pub. No.: WO2022/108232
PCT Pub. Date: May 27, 2022

(65) Prior Publication Data

US 2024/0011490 A1 Jan. 11, 2024

(30) Foreign Application Priority Data

Nov. 20, 2020 (DE) ..... 10 2020 130 766.7
Aug. 17, 2021 (DE) ..... 10 2021 121 375.4

(51) Int. Cl.
*F04C 29/02* (2006.01)
*F04C 18/02* (2006.01)

(52) U.S. Cl.
CPC ..... *F04C 29/026* (2013.01); *F04C 18/0215* (2013.01)

(58) Field of Classification Search
CPC ..... F04C 29/026; F04C 18/0215
See application file for complete search history.

(56) References Cited

FOREIGN PATENT DOCUMENTS

| | | | | |
|---|---|---|---|---|
| EP | 3584443 | A1 * | 12/2019 | ..... F04B 39/02 |
| JP | 006220142 | A | 8/2006 | |
| JP | 2006283605 | A | 10/2006 | |
| JP | 2008088945 | A | 4/2008 | |

(Continued)

OTHER PUBLICATIONS

English Translation JP-2019056322-A (Year: 2019).*
English Translation WO-2018046255-A1 (Year: 2017).*

*Primary Examiner* — Shafiq Mian
(74) *Attorney, Agent, or Firm* — Shumaker, Loop & Kendrick, LLP; James D. Miller

(57) ABSTRACT

A scroll compressor for refrigerant-oil mixtures with oil return, including a housing element and a fixed scroll, wherein the housing element is connected to the fixed scroll by means of a seal in such a way that an outlet chamber is formed between the housing element and the fixed scroll, wherein, for oil separation and oil return purposes, an oil separation chamber, which has a high-pressure refrigerant outlet and an oil collection area, and an oil return channel towards a suction pressure chamber are arranged downstream of the outlet chamber, the scroll compressor being characterized in that an outlet chamber drain for draining oil into the oil return channel of the oil separation chamber is formed in the geodetic lower region of the outlet chamber.

16 Claims, 6 Drawing Sheets

(56) References Cited

FOREIGN PATENT DOCUMENTS

| | | | | |
|---|---|---|---|---|
| JP | 2019056322 | A | * | 4/2019 |
| JP | 2019056322 | A | | 4/2019 |
| KR | 101955985 | B1 | | 3/2019 |
| WO | WO-2018046255 | A1 | * | 3/2018 |
| WO | 2018151061 | A1 | | 8/2018 |

* cited by examiner

SCROLL COMPRESSOR FOR REFRIGERANT-OIL MIXTURES WITH OIL RETURN

CROSS REFERENCE TO RELATED PATENT APPLICATIONS

This is a U.S. national phase patent application of PCT/KR2021/016395 filed Nov. 11, 2021 which claims the benefit of and priority to German Pat. Appl. No. 10 2021 121 375.4 filed on Aug. 17, 2021 and German Pat. Appl. No. 10 2020 130 766.7 filed on Nov. 20, 2020, the entire contents of each of which are incorporated herein by reference.

TECHNICAL FIELD

The invention relates to a scroll compressor for compression refrigeration systems, in which refrigerant-oil mixtures are compressed. After being compressed, the refrigerant oil is separated off and is fed in a short circuit to the areas of the mechanical compressor elements to be lubricated, in order to efficiently lubricate the compressor.

BACKGROUND ART

Downstream of the compression chamber, refrigerant compressors of the generic type have an outlet chamber, into which the refrigerant-oil mixture is introduced at high pressure. The outlet chamber has just one output for the compressed mixture containing the refrigerant oil, which leads directly to the oil separator. In the oil separator, the oil is separated and is routed by means of an oil return channel, via at least one pressure-reducing element, to the suction side upstream of the compressor unit. The outlet chamber itself has no special construction elements that have the function of an oil separator, since a specially designed oil separator is arranged downstream. Accordingly, there is also no oil return path or the like. The outlet chamber is preferably designed as a cavity with the largest possible volume, since a large volume provides damping of the discharge pressure pulses and thus an improved NVH behavior (Noise, Vibration, Harshness).

One known problem with scroll compressors according to the prior art is that the outlet chamber in the rear housing downstream of the compressor unit is not designed as an oil separator, since usually a large-volume chamber is preferably placed at this location in order to dampen the discharge pressure pulses. Because the volume of this chamber is large in comparison to the outlet of the fixed scroll, the flow velocity is significantly reduced. Particularly in the case of low mass flows, the reduction in the flow velocity in the outlet chamber unintentionally acts as an oil separator on account of the different mass inertias of oil and refrigerant.

In the case of low mass flows, therefore, the oil separated in the outlet chamber is no longer available to the compressor. Only when operating with high mass flows at high speeds, for example, can this oil be transported away from the outlet chamber and made available to the compressor again.

From the prior art, JPA 2019-056322 discloses a refrigerant compressor having two successively arranged oil separators and two separate oil return channels, in order to overcome the aforementioned disadvantage of scroll compressors.

In said document, construction elements that have the aim of separating oil are already implemented in the outlet chamber in order to create an additional oil separator arranged upstream. Furthermore, the oil intentionally separated in the first upstream oil separator is routed directly to the compressor unit by a dedicated oil return channel which likewise has a dedicated nozzle element. This oil return channel is formed in addition to the usual oil return channel, which is fed by the oil separated in the oil separator according to the prior art. The oil return channels lead to separately positioned inlets into the suction chamber and into the compressor chamber of the scroll compressor.

SUMMARY

The object of the invention is to improve the oil return in the compressor so as to ensure stable and reliable lubrication of the compressor in operating states with lower mass flow.

The object is achieved by a subject-matter having the features as shown and described herein.

The object of the invention is achieved in particular by a scroll compressor for refrigerant-oil mixtures with oil return, which comprises, in addition to other customary components of a scroll compressor, a housing element and a fixed scroll attached thereto. The housing element is connected to the fixed scroll in such a way that an outlet chamber for the compressed refrigerant-oil mixture is formed between the housing element and the fixed scroll, downstream of the pressure chamber, and in such a way that the outlet chamber is bounded by the housing element and the fixed scroll. In order to seal off the outlet chamber as a space, a seal is arranged between the housing element and the fixed scroll. For oil separation and oil return purposes, an oil separation chamber, which for its part has a high-pressure refrigerant output and an oil collection area, is provided downstream of the outlet chamber. An oil return channel towards the suction pressure chamber of the scroll compressor is arranged in the lower region of the oil collection area. The pressure difference is equalized via a nozzle element or the like. The scroll compressor is characterized in that an outlet chamber drain for draining oil into the oil return channel of the oil separation chamber is formed in the geodetic lower region of the outlet chamber. Via the outlet chamber drain, in operating states with low mass flows, the oil separated in the outlet chamber passes for example directly and along the shortest possible route into the oil return channel and subsequently into the suction pressure chamber in order to lubricate the moving parts of the scroll compressor.

Preferably, an outlet chamber valve is integrated in the outlet chamber of the scroll compressor and is arranged and formed in such a way that a compressor outlet, which is arranged in the fixed scroll and leads towards the outlet chamber, can be controlled thereby. The outlet chamber valve thus controls the refrigerant-oil mass flow that enters the outlet chamber from the compressor outlet.

With particular preference, an outlet chamber channel for connection to the oil separation chamber for the refrigerant-oil mixture is formed in the geodetic upper region of the outlet chamber. Following the compression process and after flowing through the outlet chamber, the refrigerant-oil mixture thus passes via the outlet chamber channel into the oil separation chamber, in which the intentional oil separation from the mixture then takes place.

Advantageously, both the oil separation chamber and the oil return channel are integrated in the housing element, so that no additional components are required.

One advantageous embodiment of the invention consists in that the oil return channel is formed at least partially through the fixed scroll towards the suction pressure chamber. In such an embodiment, the transition of the oil return channel from the housing element to the fixed scroll is made fluid-tight by means of a seal.

With particular preference, the outlet chamber drain is formed as a channel likewise in the housing element.

The concept of the invention is expanded upon in that the channel is formed as a bore in the housing element. From a manufacturing point of view, this is a very simple and uncomplicated measure for implementing the channel.

Another advantageous embodiment of the channel consists in forming it as a stepped bore in the housing element, a nozzle-like constriction being formed upstream of the connection to the oil return channel. By way of the nozzle-like constriction, particularly precise control of the fluid flow flowing through the channel into the oil return channel is possible.

With particular advantage, a separate nozzle element is arranged in the channel, which nozzle element is particularly preferably interchangeable. Thus, when changing the refrigerant oil for example, the nozzle element can be adapted to different rheological properties of the oil.

As an alternative to forming a channel according to what has been stated above, the outlet chamber drain is formed as a groove in the sealing surface of the housing element.

As a further alternative, the outlet chamber drain is formed as a groove in the sealing surface of the fixed scroll.

As a further alternative, the outlet chamber drain is formed as a seal with a cutout, so that the outlet chamber drain is formed by an aperture in the seal.

Another advantageous alternative embodiment of the outlet chamber drain consists in forming it as a channel in the sealing surface of the housing element.

The aforementioned embodiment is advantageously further improved if the channel in the sealing surface of the housing element is formed as a labyrinth or in a meandering manner.

When formed as a bore or as a circular channel, the outlet chamber drain preferably has at the narrowest point a circular flow cross-section with a diameter of 1.2 mm.

If the diameter of the outlet chamber drain is too large, this leads to a significant increase in back-pressure for the pressing of the orbiting scroll.

This corresponds approximately to a flow cross-section of 1.131 $mm^2$ of the outlet chamber drain at the narrowest point, for example the nozzle opening.

The concept of the invention consists in providing not a second oil return channel but rather a second inlet to the existing oil return channel, in order to conduct away from the outlet chamber the quantities of oil that have been unintentionally separated as a function of the operating point. This second inlet is arranged downstream of the standard oil separator but upstream of the nozzle element of the oil return channel and is therefore at approximately the same pressure as the oil separated in the oil separation chamber, so as to make available to the compressor again the quantity of oil that has been unintentionally separated in the outlet chamber as a function of the mass flow. The shape and cross-section of the further output, the outlet chamber drain, must be designed in such a way that on the one hand the oil can be drained from the outlet chamber, and on the other hand the efficiency of the compressor should not be reduced and the back-pressure system that possibly exists for the pressing of the movable scroll should not be changed at operating points where no oil or only a small quantity of oil is separated.

Accordingly, the outlet from this chamber should be arranged close to the bottom. In particular, the inlet to the standard oil return channel must be positioned in such a way that no refrigerant is mixed into the oil return at operating points with little separated oil in the chamber, since this leads, inter alia, to a reduction in the viscosity of the oil-refrigerant mixture and thus to an increase in back-pressure.

The refrigerant-oil mixture reaches the outlet chamber in the rear housing downstream of the compressor outlet of the fixed scroll. After the outlet chamber, the refrigerant-oil mixture enters the oil separator. From there, the low-oil portion of the refrigerant-oil mixture leaves the compressor via the high-pressure refrigerant output. The separated oil is transported via the oil return channel to the suction side.

The invention solves the stated problem in a way that is particularly easy to implement, with little design effort. The unintentionally separated oil is removed from the outlet chamber by means of the second outlet, the outlet chamber drain, to the oil return channel. This is an improved oil management, which leads, inter alia, to a reduction in the quantity of oil required for the air-conditioning system and thus to an improved performance characteristic of the system.

An improvement in the pulsation characteristic under operating conditions with low flow is also associated with this concept. It is particularly advantageous that there are no negative effects on the efficiency and on the possible back-pressure for the pressing of the orbiting scroll of the electric compressor.

One particular advantage of the invention is that, on account of the reduced quantity of unintentionally separated oil, the pulsation characteristic under operating conditions with low mass flows, or flow rates, is improved.

In order to incorporate in the lubrication circuit the mass flow that is unintentionally separated in the outlet chamber, the separated oil is fed back to the compressor by a further inlet to the already established oil return. The shape and the cross-section of the connection are advantageously designed in such a way that the unintentionally collected oil is drained from the outlet chamber into the defined oil return path, and the efficiency and back-pressure characteristic is not changed.

BRIEF DESCRIPTION OF DRAWINGS

Further details, features and advantages of embodiments of the invention will become apparent from the following description of exemplary embodiments with reference to the associated drawings, in which.

DESCRIPTION OF AN EMBODIMENT

Figure 1A:
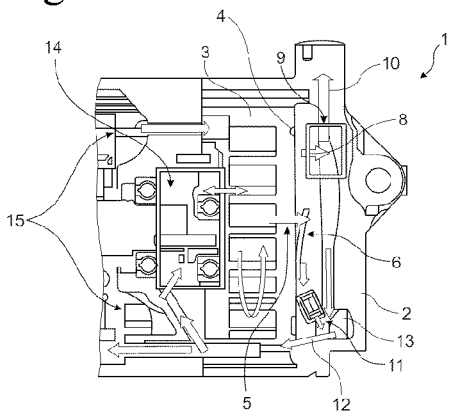
FIG. 1A: shows part of the scroll compressor, in longitudinal section

FIG. 1 shows part of a scroll compressor 1 in longitudinal section. In the diagram, the scroll compressor 1 is shown with the components housing element 2 and fixed scroll 3, which are connected to one another. Between the housing element 2 and the fixed scroll 3, sub-regions of the surfaces bearing against one another are sealed in a fluid-tight manner by a seal 4. In the fixed scroll 3, a compressor outlet 5 is formed as a passage, through which the compressed refrigerant-oil mixture flows at high pressure into the outlet chamber 6 formed between the fixed scroll 3 and the housing element 2. The outlet chamber 6 is formed as a cavity within the housing element 2 and is bounded on one side by the back of the fixed scroll 3. In its upper region, the outlet chamber 6 has an outlet chamber channel 8, which opens into the oil separation chamber 9. The oil separation chamber 9 has in the upper region a high-pressure refrigerant output 10, and in the lower region an oil collection area 13 with a particle filter optionally pressed therein. The latter is positioned in such a way that the channel from the outlet chamber 6 is still upstream of the filter, so that oil still has to pass through the filter when entering the oil return channel 12.

From the oil collection area 13, the oil return channel 12 extends towards the fixed scroll 3, where the oil return channel 12 is routed through the latter and finally ends in the suction pressure chamber 15 or the back-pressure chamber 14 with corresponding throttle elements. In the embodiment described above, the scroll compressor 1 corresponds to the prior art. The mass flow of the refrigerant-oil mixture in the scroll compressor 1 is routed as follows. After the mechanical compressor unit of the scroll compressor 1, the refrigerant-oil mixture is conveyed via the compressor outlet 5 in the fixed scroll 3, also referred to as the main outlet, into the high-pressure area of the rear housing, the outlet chamber 6. Due to the increase in size of the flow cross-section from the compressor outlet 5 to the outlet chamber 6, oil entering the outlet chamber 6 with the refrigerant-oil mixture is separated from the refrigerant and is not transported further. This takes place, for example, as a function of the operating conditions at lower speeds of the scroll compressor 1. The separation of some of the oil from the refrigerant-oil mixture is not intentional at this location, and only under operation conditions with relatively high volume flows is the oil that has been unintentionally separated in the outlet chamber 6 picked up again by the refrigerant mass flow and transported away. Accordingly, therefore, the quantity of oil currently circulating depends on the operating conditions of the scroll compressor 1. The refrigerant-oil mixture leaves the outlet chamber 6 towards the oil separation chamber 9, which is designed as a cyclone separator. In the oil separation chamber 9, refrigerant and oil are separated due to the differences in density. The refrigerant finally leaves the scroll compressor 1 via the high-pressure refrigerant output 10. The oil separated in the oil separation chamber 9 collects in the oil collection area 13 and is transported via the oil return channel 12 to the suction pressure chamber 15 and the back-pressure chamber 14.

Depending on the design of the scroll compressor 1, the back-pressure for the pressing of the orbiting scroll is also adjusted in the back-pressure chamber 14 by the oil return channel 12, as indicated in FIG. 1.

The present invention is characterized in that a second outlet to the oil return channel 12 is provided in the housing element 2. This is highlighted in the exemplary embodiment shown in FIG. 1A. This second outlet is formed as an outlet chamber drain 11 and connects the outlet chamber 6, and in particular the geodetic lower region of the outlet chamber 6, to the oil return channel 12.

As already described above, after the compressor unit, the refrigerant-oil mixture is conveyed via the compressor outlet 5 of the fixed scroll 3 into the high-pressure area of the housing element 2, the outlet chamber 6. Due to the increase in size of the flow cross-section, some of the oil of the refrigerant-oil mixture is not transported onwards by the refrigerant-oil mixture, depending on the operating conditions in each case. This undesirable side effect occurs at lower speeds of the scroll compressor 1. The quantity of oil in the outlet chamber 6 therefore depends on the operating conditions. The oil return is achieved in that the mass flow of the refrigerant-oil mixture leaves the outlet chamber 6 towards the oil separation chamber 9, and refrigerant and oil are separated therein. The refrigerant freed of oil in the oil separation chamber, which still contains a small quantity of oil, leaves the scroll compressor 1 via the high-pressure refrigerant output 10 of the scroll compressor. The intentionally separated oil from the oil separation chamber 9 is collected in the oil collection area 13 formed in the housing and is transported via the oil return channel 12 to the suction side of the scroll compressor 1. Depending on the design of the compressor, the back-pressure for the pressing of the orbiting scroll is also adjusted by this channel. Of critical importance for improving the oil circulation is the additional inflow to the oil return from the outlet chamber 6 through the outlet chamber drain 11, which is provided according to the invention. A small volume flow, which contains mainly oil, leaves the outlet chamber 6 at the bottom of the outlet chamber 6 through the outlet chamber drain 11. This oil volume flow contains only a small proportion of refrigerant dissolved therein and is added to the oil volume flow in the oil return channel 12. This takes place as a function of the operating conditions and is shown schematically by arrows in the lower region of the housing element 2.

Figure 1B:
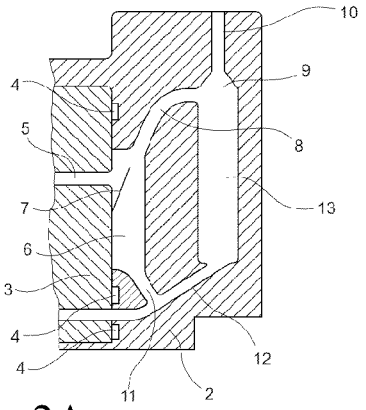
FIG. 1B: shows a detail of the housing element and of the fixed scroll, in longitudinal section

In FIG. 1B, the housing element 2 and the fixed scroll 3 accommodated by the latter are shown in a highly schematic manner as essential components of the scroll compressor 1. The channels for receiving and routing the refrigerant-oil mixture are shown on an enlarged scale here.

The compressor outlet 5 in the fixed scroll 3 opens into the outlet chamber 6, the walls of which are formed on the one hand by the housing element 2 and on the other hand by the fixed scroll 3. To seal the outlet chamber 6, a seal 4 is arranged between the fixed scroll 3 and the housing element 2. In the upper region, the outlet chamber 6 merges into an outlet chamber channel 8, which opens into the oil separation chamber 9. The latter has the high-pressure refrigerant output 10 in the upper region and the oil collection area 13 in the lower region. Starting in the oil collection area 13 is the oil return channel 12, into which the outlet chamber drain 11 from the outlet chamber 6 opens.

The oil that under certain operating conditions is already unintentionally separated in the outlet chamber 6 can thus pass via the outlet chamber drain 11 directly into the oil return channel 12, and the oil circulation can be maintained under all operating conditions, particularly even when only relatively low volume flows are being conveyed at relatively low speeds. The oil return channel 12 extends first in the housing element 2 to the fixed scroll 3 and continues to extend in the latter, a seal 4 accordingly being arranged in this region in order to seal the transition from the housing element 2 to the fixed scroll 3.

In the exemplary embodiment shown, arranged in the outlet chamber 6 is the outlet chamber valve 7, which controls the mass flow of the refrigerant-oil mixture from the compressor outlet 5.

Figure 2A:
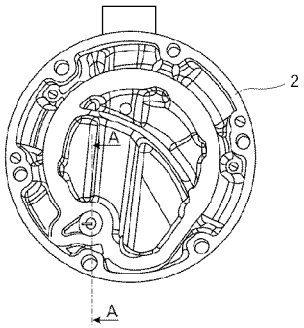
FIG. 2A: shows the housing element, in an axial view

FIGS. 2A, B, C, D, E and F show a housing element 2, in which an outlet chamber drain is formed as a channel 17.

Figure 2B:
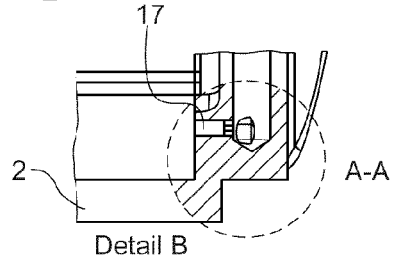
FIG. 2B: shows the housing element, section A-A

FIG. 2A shows an axial view of the housing element 2 in cross-section, with a labelled section A-A which is shown in FIG. 2B.

Figure 2C:
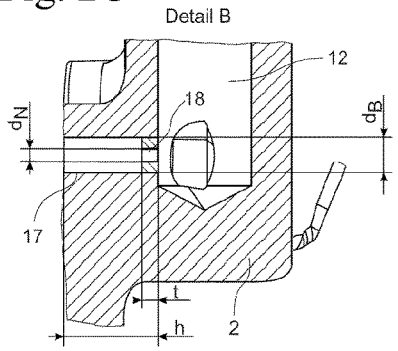
FIG. 2C: shows the nozzle element, detail B, formed in an integrated manner

Detail B from FIG. 2B is finally shown on an enlarged scale in FIG. 2C. According to this embodiment of the invention, a nozzle geometry of the channel 17 is integrated in the material of the housing element 2. To visualize the nozzle element, a different hatching is selected, the nozzle element itself being part of the base material. The variable nozzle thickness t corresponds to the flow length of the nozzle. The nozzle position can be arranged along the bore axis in the region of the bore depth h of the channel 17. The nozzle diameter $d_N$ and the bore diameter $d_B$ are again shown schematically in FIG. 2C. The arrangement of the nozzle and the diameters of the channel 17 and of the nozzle are variable depending on the refrigerant used, the oil, and the operating conditions.

It should be emphasized that a variable cross-section can also be formed along the nozzle thickness t.

Figure 2D:
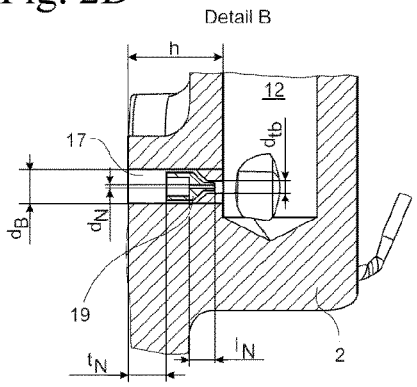
FIG. 2D: shows the nozzle element, detail B, formed separately

FIG. 2D shows a separate nozzle element 19 according to detail B based on FIG. 2B. The separate nozzle element 19 has a diameter $d_N$. The nozzle may be reversibly interchangeable and the external geometry and shape of the nozzle may differ from the shape shown. Advantageously, a variable nozzle cross-section can be formed along the nozzle length $l_N$, it being possible for $l_N$ to differ on the basis of the nozzle geometry and available material thickness. The nozzle length $l_N$ extends over the entire thin nozzle diameter $d_N$ of the nozzle element 19. A variable bore diameter for the nozzle inlet $d_B$ and nozzle outlet $d_{TB}$ are also shown in FIG. 2D. The position $t_N$ of the nozzle element 19 along the bore depth h is variable. The nozzle element 19 may for example be fixed in the bore by various ways of fastening, namely in a form-fitting, materially bonded or force-fitting manner. The position of the nozzle element 19 over the height h, the bore depth, may be specified depending on the type of form-fitting, materially bonded or force-fitting connection.

Figure 2E:
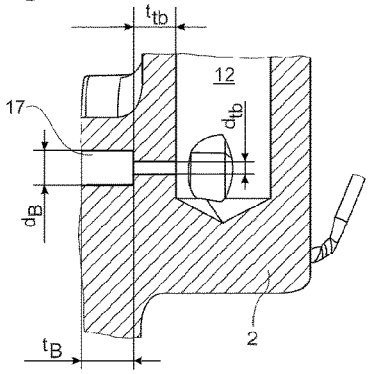
FIG. 2E: shows the nozzle element, detail B, formed as a stepped bore

In FIG. 2E, a directly produced bore is formed as the channel 17. The bore diameter $d_B$ and the nozzle outlet $d_{TB}$ may vary accordingly. The bore depth $t_B$ and $t_{TB}$ can also be adapted depending on the available space. A variable ratio between $t_{TB}$ and $t_B$ and d TB is possible so that, for example, the flow resistance or the mass flow can be adjusted. As a general requirement, $d_B$ is greater than $d_{TB}$, and preferably $d_B$ is very much greater than $d_{TB}$.

The channel 17 is thus designed as a stepped bore, initially having the bore diameter $d_B$ over the length of the bore depth $t_B$ and then having the diameter of the nozzle outlet $d_{TB}$ over the length $t_{TB}$.

The bore as the channel 17 may alternatively also be formed without a constriction of the cross-section, namely with the diameter of the nozzle outlet $d_{tb}$. There is then a constant bore diameter $d_B$ over the entire length $t_B$ and $t_{tb}$.

Figure 2F:
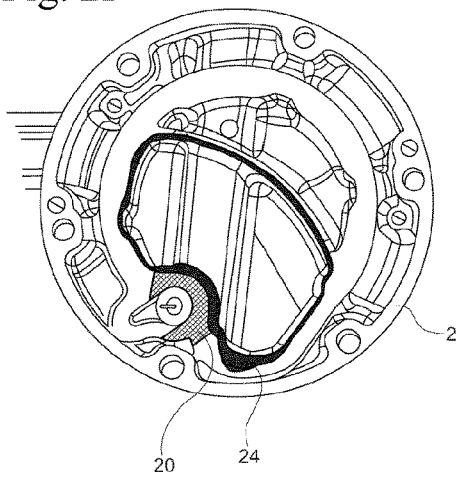
FIG. 2F: shows the housing element with the seal, in cross-section

FIG. 2F shows a position range specification for the aforementioned embodiment. The housing element 2 and part of the sealing surface 20 from the sealing region 24 between the fixed scroll 3 and the housing 2 are shown. All versions or variants can be positioned on the marked sealing surface 20. Furthermore, a completely filled area is shown, within which the individual channels 17 are formed. If necessary, material accumulations can be added if the available material thickness is insufficient. This additional material accumulation must enable a connection to the high-pressure channel.

All versions of the variants shown in FIGS. 2A to 2E can be executed perpendicular, parallel or in an inclined manner relative to the illustrated plane of the diagram 2F.

FIGS. 3A to G show embodiments of the invention in which the sealing surface in the housing element 2 or in the fixed scroll 3 is interrupted, partially removed, for example cut away or milled away. The seals 4 shown in the figures are designed for example as O-rings, molded rubber seals, and coated or uncoated metal seals.

FIGS. 3A to 3D show grooves in the sealing surface of the outer housing, the housing element 2.

Figure 3A:
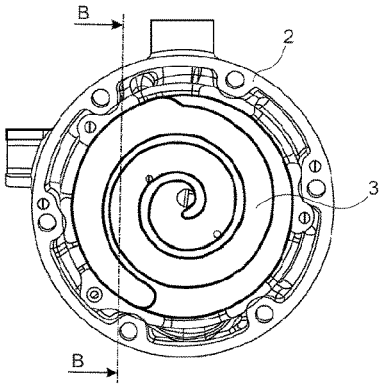
FIG. 3A: shows the fixed scroll and the housing element, in an axial view

In FIG. 3A, the fixed scroll 3 and the housing element 2 are shown in an axial view.

Figure 3B:
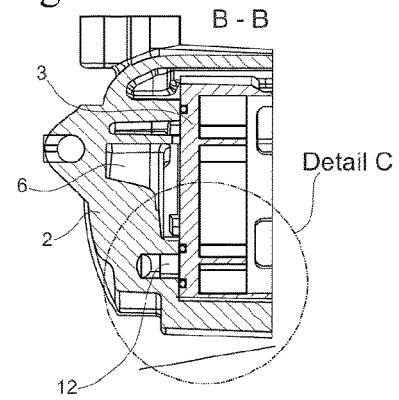
FIG. 3B: shows the housing element, section B-B

FIG. 3B shows the longitudinal section B-B through the relevant region of the scroll compressor 1.

Figure 3C:
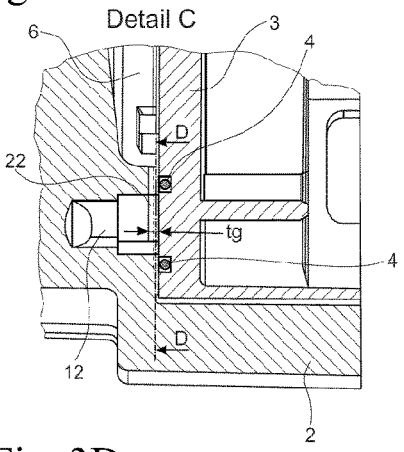
FIG. 3C: shows the housing element, detail C

In FIG. 3C, detail C is now shown on an enlarged scale, and the groove depth $t_G$ as well as the seal 4 and the section line D-D are shown.

Figure 3D:
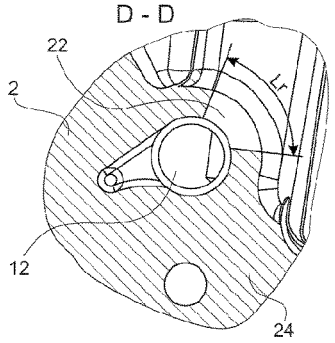
FIG. 3D: shows the housing element, section D-D, gap sector

FIG. 3D finally shows the section D-D, with the housing element 2 being cut away and the oil return channel 12 being shown. The groove 22 has the tangential groove length $L_R$, which is shown as a sector.

The groove 22 in the housing element 2 establishes the connection between the outlet chamber 6 and the oil return channel 12. The seal 4 does not act across the width of the groove 22. The value of the groove depth $t_G$ and of the tangential groove length $l_R$ or $L_R$ is variable, with the aim being that no large particles can pass through the resulting cross-section of the groove 22. The groove depth $t_G$ and the tangential groove length $l_R$ or $L_R$ define the required flow-limiting characteristic. The position of the groove 22 can be freely selected in the entire sealing region 24 towards the fixed scroll 3, provided that a connection to the oil return channel 12 is possible. The groove 22 can be produced by milling, as a pre-cast or forged feature, or by any other method.

Figure 3E:
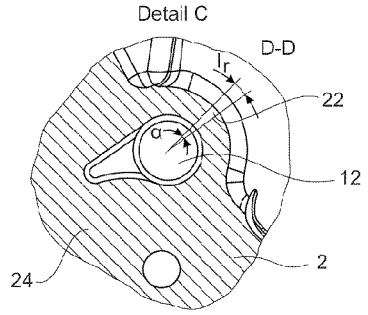
FIG. 3E: shows the housing element, section D-D, gap length

The diagram in FIG. 3E is added, which shows the section D-D in a different embodiment. In this case, this embodiment is characterized in that a slot is formed in the housing sealing wall of the housing element 2 towards the fixed scroll 3. The groove depth $t_G$ (not shown) of the groove 22 is variable and is large in comparison to the embodiment shown in FIG. 3D. The variable tangential groove length $l_R$ is small in comparison to the embodiment shown in FIG. 3D. Both dimensions once again define the required flow-limiting characteristic. The position of the groove 22, which is designed as a slot, can be freely selected in the entire sealing region 24 towards the fixed scroll 3, provided that a connection to the oil return channel 12 is provided. The slot may once again be produced by milling, as a pre-cast or forged feature, or by any other method.

Figure 3F:
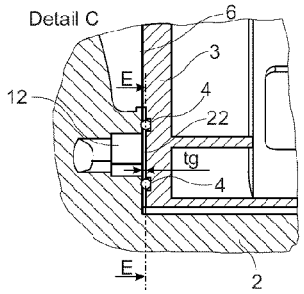
FIG. 3F: shows the housing element, detail C

FIG. 3F shows detail C with the outlet chamber 6, the housing element 2 and the fixed scroll 3, as well as the seals 4 and the groove 22, wherein in this embodiment the groove 22 is made or formed in the fixed scroll 3. Also shown is the section E-E, which extends through the seal 4. Here, the line bounding the outlet chamber 6 is in line with the sealing surface of the housing element 2.

The groove depth $t_G$ and the tangential groove length $l_R$ or $L_R$ are variable. Both values are selected in such a way that the required flow-limiting characteristic is achieved. The position of the groove 22 can be freely selected along the sealing line between the housing element 2 and the fixed scroll 3, provided that a connection to the oil return channel 12 can be achieved. The groove 22 may be produced by milling, as a pre-cast or forged feature, or by any other method. The shape of the groove 22 may differ from the illustration shown, without departing from the path of the concept of the invention.

Figure 3G:
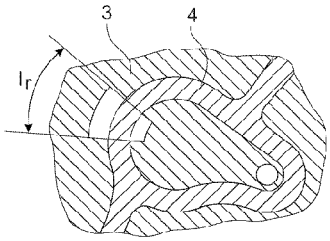
FIG. 3G: shows the housing element, seal, gap sector

FIG. 3G shows the section E-E in the seal 4, the groove length $l_R$ in the plan view being formed in the fixed scroll 3.

Figure 4A:
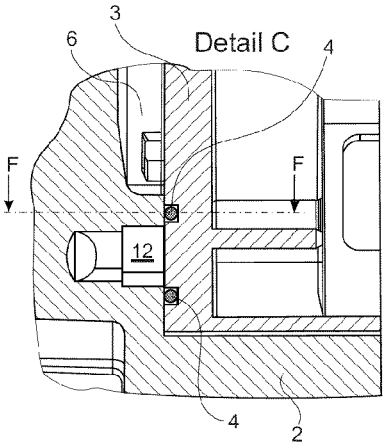
FIG. 4A: shows the housing element, detail C, channel in seal
Figure 4B:
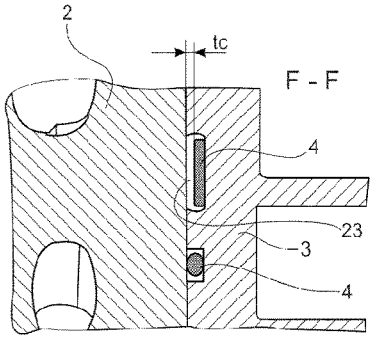
FIG. 4B: shows the housing element, section F-F

FIGS. 4A and 4B show a further embodiment with an adapted seal 4.

FIG. 4A shows detail C with the fixed scroll 3, the housing element 2, the outlet chamber 6 formed therebetween, and the oil return channel 12. The crucial feature is the cut-away seal 4, which between the outlet chamber 6 and the oil return channel 12 is cut away such that oil cannot pass from the outlet chamber 6 into the oil return channel 12 and the seal 4 at the cut-away point is not effective but rather allows an intentional and controlled passage of the oil through the seal 4 or past the seal 4.

The section line F-F is shown in detail on an enlarged scale in FIG. 4B. The cutout 23 in the seal 4 is shown here, the cutout having a seal cutting depth $t_c$. The variable seal cutting depth $t_c$ can also be produced by a modification in the mold. A variable cutting length along the sealing element ensures that no large particles pass through the resulting cross-section. Both values are selected in such a way that the required flow-limiting characteristic is achieved. The position is freely selected along the entire sealing line between the housing and the fixed scroll, provided that a connection to the oil return channel 12 is provided.

Figure 4C:
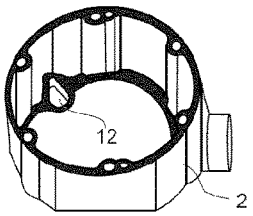
FIG. 4C: shows the housing element with the seal, in a perspective view

FIG. 4C shows the housing element 2 with the oil return channel 12, in a perspective view.

Figure 4D:
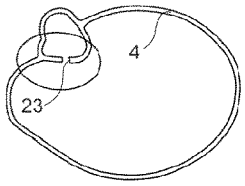
FIG. 4D: shows the seal with a gap
Figure 4E:
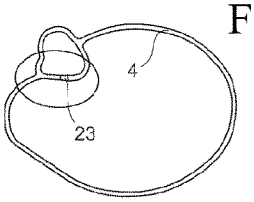
FIG. 4E: shows the seal with a groove

FIGS. 4D and 4E each show a seal 4 which can in part be passed by oil. The seal 4 may be designed as a sealing ring, as a molded rubber part or as a coated or uncoated metal bead seal. The depth and length of the passable portion of the seal are adjusted on the basis of functional tests in such a way that the required characteristic is achieved. The passable portion of the seal 4 can be moved freely along the sealing line, provided that a connection to the oil return channel 12 and/or to the outlet channel is possible.

FIG. 4D shows a fully slotted seal 4 with a cutout 23. The cutout 23 is designed as a slot over the entire seal 4.

Figure 4F:
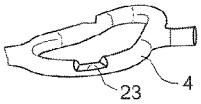
FIG. 4F: shows an enlarged view of the seal with a groove

FIG. 4E shows a design of the seal 4 where the cutout 23 is not formed over the entire height of the sealing element, in contrast to FIG. 4D. The region of the seal 4 with the cutout 23 is shown on an enlarged scale in FIG. 4F. Here, the seal 4 is cut away only over part of the height of the sealing element.

Figure 5A:
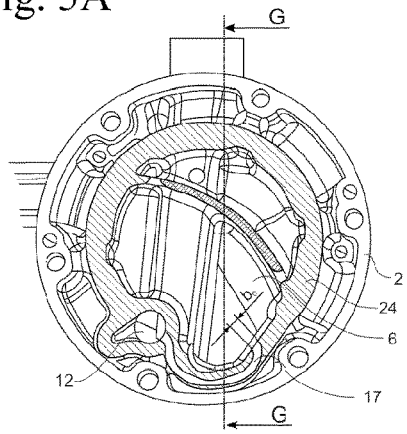
FIG. 5A: shows the housing element in cross-section with a channel
Figure 5B:
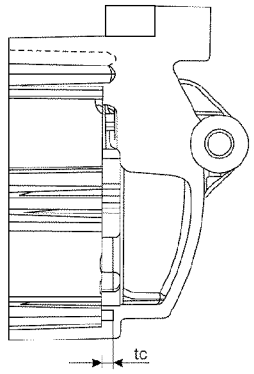
FIG. 5B: shows the housing element, section G-G
Figure 5C:
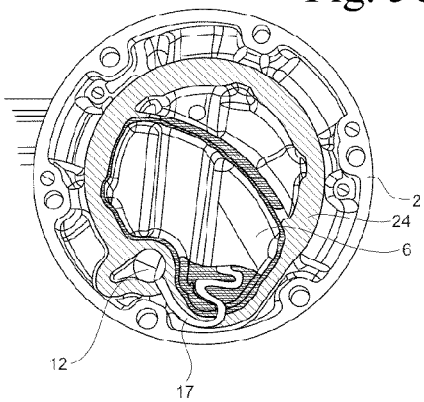
FIG. 5C: shows the housing element in cross-section with a meandering channel.

In FIGS. 5A, 5B and 5C, channels 17 for conveying the oil out of the outlet chamber 6 are formed on the sealing region 24 of the housing element 2.

FIG. 5A shows the housing element 2, in which the outlet chamber 6 is arranged. The channel 17 connects the outlet chamber 6 to the oil return channel 12. The channel 17 has a channel width $b_c$.

FIG. 5B shows the section G-G from FIG. 5A, this diagram showing the channel depth $t_c$, which corresponds to the corresponding preceding exemplary embodiment of the seal cutting depth.

To adjust the flow characteristic, a variable channel contour and/or channel width $b_e$ and channel depth $t_c$ are selected. The length of the channel 17 is adapted to the high-pressure chamber geometry. The channel 17 is produced for example during the process of casting, forging or machining the housing element 2. The channel 17 is also designed as a laminar flow throttle, for example with a flat scroll shape or by means of a 3D scroll shape.

In FIG. 5C, the channel 17 is shown as a meandering connection of the outlet chamber 6 to the oil return channel 12 in the housing element 2. This embodiment of the channel 17 will also be referred to as a labyrinth, which also includes a meandering design of the channel 17. For the embodiments of the channel 17 in the housing element 2 or as a labyrinth, an alternative embodiment is that the channel 17 may also be provided by a separate part, for example a seal or a spiral nozzle. The material required in order to form the labyrinth channel, as shown in FIG. 5C, must be made available within the housing element 2. The labyrinth may be produced by way of prefabricated molds, forged molds, or by machining. All the properties, particularly the possibility of acting as a laminar flow throttle, also apply to this embodiment.

List of Reference Numerals

TABLE 1

| | |
|---|---|
| 1 | scroll compressor |
| 2 | housing element |
| 3 | fixed scroll |
| 4 | seal |
| 5 | compressor outlet |
| 6 | outlet chamber |
| 7 | outlet chamber valve |
| 8 | outlet chamber channel |
| 9 | oil separation chamber |
| 10 | high-pressure refrigerant output |
| 11 | outlet chamber drain |
| 12 | oil return channel |
| 13 | oil collection area |
| 14 | back-pressure chamber |
| 15 | suction pressure chamber |
| 16 | compressor chamber |
| 17 | channel |
| 18 | nozzle-like constriction |
| 19 | nozzle element |
| 20 | sealing surface |
| 22 | groove |
| 23 | cutout |
| 24 | sealing region |
| t | nozzle thickness |
| h | bore depth |
| $d_B$ | bore diameter |
| $d_N$ | nozzle diameter |
| $l_N$ | nozzle length |
| $d_{TB}$ | nozzle outlet |
| $t_{TB}$, $t_B$ | bore depth |
| $t_G$ | groove depth |
| tN | position of nozzle element |
| $t_B$ | length |

TABLE 1-continued

| | |
|---|---|
| $l_R$, $L_R$ | groove length |
| $t_c$ | seal cutting depth, channel depth |
| $b_e$ | channel width |

The invention claimed is:

1. A scroll compressor for a refrigerant-oil mixture with oil return, comprising:

a housing element; and a fixed scroll, wherein the housing element is connected to the fixed scroll by a seal in such a way that an outlet chamber is formed between the housing element and the fixed scroll, wherein, for oil separation and oil return purposes, an oil separation chamber, which has a high-pressure refrigerant output and an oil collection area, and an oil return channel towards a suction pressure chamber are arranged downstream of the outlet chamber, wherein an outlet chamber drain for draining oil into the oil return channel of the oil separation chamber is formed in a geodetic lower region of the outlet chamber, and wherein the outlet chamber drain is directly connected to the oil return channel of the oil separation chamber.

2. The scroll compressor according to claim 1, wherein an outlet chamber valve is arranged and formed in the outlet chamber in such a way that a compressor outlet arranged in the fixed scroll can be controlled thereby.

3. The scroll compressor according to claim 1, wherein an outlet chamber channel for connection to the oil separation chamber for the refrigerant-oil mixture is formed in a geodetic upper region of the outlet chamber.

4. The scroll compressor according to claim 1, wherein the oil separation chamber and the oil return channel are integrated in the housing element.

5. The scroll compressor according to claim 1, wherein the oil return channel is formed at least partially through the fixed scroll towards the suction pressure chamber.

6. The scroll compressor according to claim 1, wherein the outlet chamber drain is formed as a channel in the housing element.

7. The scroll compressor according to claim 6, wherein the channel is formed as a bore in the housing element.

8. The scroll compressor according to claim 6, wherein the channel is formed as a stepped bore in the housing element, a nozzle-like constriction being formed upstream of a connection to the oil return channel.

9. The scroll compressor according to claim 6, wherein a separate nozzle element is arranged in the channel.

10. The scroll compressor according to claim 1, wherein the outlet chamber drain is formed as a groove in a sealing surface of the housing element.

11. The scroll compressor according to claim 1, wherein the outlet chamber drain is formed as a groove in a sealing surface of the fixed scroll.

12. The scroll compressor according to claim 1, wherein the outlet chamber drain is formed as the seal with a cutout.

13. The scroll compressor according to claim 1, wherein the outlet chamber drain is formed as a channel in a sealing surface of the housing element.

14. The scroll compressor according to claim 13, wherein the channel in the sealing surface of the housing element is formed as a labyrinth or in a meandering manner.

15. The scroll compressor according to claim 1, wherein the outlet chamber drain has at a narrowest point a circular flow cross-section with a diameter of 1.2 mm.

16. The scroll compressor according to claim 1, wherein the outlet chamber drain has at a narrowest point a flow cross-section of 1.131 $mm^2$.

* * * * *